US007450104B2

(12) United States Patent
Baik

(10) Patent No.: US 7,450,104 B2
(45) Date of Patent: Nov. 11, 2008

(54) METHOD AND APPARATUS FOR DRIVING LIQUID CRYSTAL DISPLAY

(75) Inventor: Seong Ho Baik, Gwacheon-shi (KR)

(73) Assignee: LG Display Co., Ltd., Seoul (KR)

( * ) Notice: Subject to any disclaimer, the term of this patent is extended or adjusted under 35 U.S.C. 154(b) by 606 days.

(21) Appl. No.: 10/879,852

(22) Filed: Jun. 28, 2004

(65) Prior Publication Data

US 2005/0104839 A1 May 19, 2005

(30) Foreign Application Priority Data

Nov. 17, 2003 (KR) ..... 10-2003-0081175

(51) Int. Cl.
*G09G 3/36* (2006.01)

(52) U.S. Cl. ..... 345/102; 345/690; 348/672

(58) Field of Classification Search ..... 345/87–89, 345/98, 102, 690; 348/672
See application file for complete search history.

(56) References Cited

U.S. PATENT DOCUMENTS

| | | | | |
|---|---|---|---|---|
| 5,717,422 | A * | 2/1998 | Fergason | 345/102 |
| 6,297,855 | B1 * | 10/2001 | Kondo et al. | 348/663 |
| 6,756,954 | B2 * | 6/2004 | Yamamoto et al. | 345/87 |
| 6,762,742 | B2 * | 7/2004 | Moon et al. | 345/102 |
| 7,053,881 | B2 * | 5/2006 | Itoh | 345/102 |
| 7,113,163 | B2 * | 9/2006 | Nitta et al. | 345/102 |
| 7,119,786 | B2 * | 10/2006 | Cui | 345/102 |
| 2001/0024181 | A1 * | 9/2001 | Kubota et al. | 345/87 |
| 2005/0057485 | A1 * | 3/2005 | Diefenbaugh | 345/102 |

FOREIGN PATENT DOCUMENTS

| | | |
|---|---|---|
| JP | 2001-343957 | 12/2001 |
| JP | 2002-202767 | 7/2002 |
| JP | 2003-149741 | 5/2003 |

OTHER PUBLICATIONS

First Office Action for corresponding Japanese Patent Application Serial No. 2004-191432, dated Oct. 17, 2007.

* cited by examiner

*Primary Examiner*—Richard Hjerpe
*Assistant Examiner*—Tom V Sheng
(74) *Attorney, Agent, or Firm*—Brinks Hofer Gilson & Lione

(57) ABSTRACT

A driving method and apparatus for a liquid crystal display are disclosed that stabilizes the variation of the brightness of a back light in correspondence with data to be displayed. In the method, the data is converted into brightness components. The brightness components are divided into a plurality of brightness areas. The brightness components are arranged into a histogram for each frame and thereafter a control value of a most-frequent value or average value of the histogram is extracted. The extracted control value is stored along with other control values including the extracted control value of a frame prior to the control value of the current frame by at least two frames. The brightness of the back light is controlled using the extracted control value of the current frame and one or more of the other stored control values.

19 Claims, 10 Drawing Sheets

METHOD AND APPARATUS FOR DRIVING LIQUID CRYSTAL DISPLAY

This application claims the benefit of Korean Patent Application No. P2003-81175 filed in Korea on Nov. 17, 2003, which is hereby incorporated by reference.

BACKGROUND OF THE INVENTION

1. Field of the Invention

This invention relates to a liquid crystal display, and more particularly to a driving method and apparatus for a liquid crystal display that is adaptive for making stabilizing brightness of a back light in correspondence with data to be displayed.

2. Description of the Related Art

Generally, a liquid crystal display (LCD) controls light transmittance of liquid crystal cells in accordance with video signals to thereby display a picture. Such an LCD has been implemented by an active matrix type having a switching device for each cell, and applied to a display device such as a monitor for a computer, office equipments, a cellular phone and the like. The switching device for the active matrix LCD mainly employs a thin film transistor (TFT).

FIG. 1 schematically shows a conventional LCD driving apparatus.

Referring to FIG. 1, the conventional LCD driving apparatus includes a liquid crystal display panel 2 having m×n liquid crystal cells Clc arranged in a matrix type, m data lines D1 to Dm and n gate lines G1 to Gn intersecting each other and thin film transistors TFT provided at the intersections, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, a timing controller 10 for controlling the data driver 4 and the gate driver 6 using synchronizing signals from a system 20, a direct current to direct current converter 14, hereinafter referred to as "DC/DC converter", for generating voltages supplied to the liquid crystal display panel 2 using a voltage from a power supply 12, and an inverter 16 for driving a back light 18.

The system 20 applies vertical/horizontal signals Vsync and Hsync, clock signals DCLK, a data enable signal DE and data R, G and B to the timing controller 10.

The liquid crystal display panel 2 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 8 applies a plurality of gamma voltages to the data driver 4.

The data driver 4 converts digital video data R, G and B into analog gamma voltages (i.e., data signals) corresponding to gray level values in response to a control signal CS from the timing controller 10, and applies the analog gamma voltages to the data lines D1 to Dm.

The gate driver 6 sequentially applies a scanning pulse to the gate lines G1 to Gn in response to a control signal CS from the timing controller 10 to thereby select horizontal lines of the liquid crystal display panel 2 supplied with the data signals.

The timing controller 10 generates the control signals CS for controlling the gate driver 6 and the data driver 4 using the vertical/horizontal synchronizing signals Vsync and Hsync and the clock signal DCLK inputted from the system 20. Herein, the control signal CS for controlling the gate driver 6 is comprised of a gate start pulse GSP, a gate shift clock GSC and a gate output enable signal GOE, etc. Further, the control signal CS for controlling the data driver 4 is comprised of a source start pulse SSP, a source shift clock SSC, a source output enable signal SOE and a polarity signal POL, etc. The timing controller 10 re-aligns the data R, G and B from the system 20 to apply them to the data driver 4.

The DC/DC converter 14 boosts or drops a voltage of 3.3V inputted from the power supply 12 to generate a voltage supplied to the liquid crystal display panel 2. Such a DC/DC converter 14 generates a gamma reference voltage, a gate high voltage VGH, a gate low voltage VGL and a common voltage Vcom, etc.

The inverter 16 applies a driving voltage (or driving current) for driving the back light 18 to the back light 18. The back light 18 generates light corresponding to the driving voltage (or driving current) from the inverter 16 to apply it to the liquid crystal display panel 2.

In order to display a vivid image on the liquid crystal display panel 2 driven in this manner, a distinct contrast between brightness and darkness must be made in correspondence with the image data that is input to the display. However, since the conventional back light 18 produces a constant brightness irrespective of the data, it is difficult to display a dynamic and fresh image.

SUMMARY OF THE INVENTION

A driving method and apparatus for a liquid crystal display are provided in which variations in the brightness of a back light are stabilized in correspondence with the data to be displayed.

A method of driving a liquid crystal display according to one aspect of the present invention includes (A) converting data into brightness components; (B) dividing the brightness components into a plurality of brightness areas; (C) arranging the brightness components into a histogram for each frame and thereafter extracting a control value; (D) storing the extracted control value; and (E) controlling brightness of a back light using a current control value of a current frame extracted at (C) and a prior control value prior to the current control value by at least two frames having been stored at (D).

In the method, the control value is the most-frequent value that is occupied by the largest number of brightness components in the histogram and the average value of the brightness components in the histogram.

Controlling the brightness includes keeping the brightness of the back light equal to the brightness of the previous frame when the current control value is equal to the prior control value.

Controlling the brightness includes changing the brightness of the back light in correspondence with the current control value when the current control value is different from the prior control value.

Controlling the brightness includes dividing the histogram into a plurality of brightness areas and changing the brightness of the back light in correspondence with a brightness area to which the current control value belongs.

The method further includes keeping the brightness of the back light equal to the brightness of the previous frame immediately preceding the current frame irrespective of the current control value of the frame if certain predetermined conditions are met.

The predetermined conditions include the brightness of the back light continuously changing in one direction before the current frame and then changing the other way at the current frame.

Alternatively, the predetermined conditions include the brightness of the back light continuously changing from a frame earlier than the prior frame through the current frame.

A method of driving a liquid crystal display according to another aspect of the present invention includes (A) setting conditions in which brightness of a previous frame is kept at a back light irrespective of a control value of a current frame; (B) converting data to be displayed into brightness components; (C) dividing the brightness components into a plurality of brightness areas; (D) arranging the brightness components into a histogram for each frame and thereafter extracting a control value; and (E) controlling the brightness of the back light in correspondence with the extracted control value when the extracted control value is not included in the conditions in which the brightness of the previous frame is kept.

As above, the control value is the most-frequent value or the average value of the histogram.

The brightness of the back light is set differently for each brightness area to which the control value belongs.

The condition in which the brightness of the previous frame is kept includes the brightness of the back light changes continuously in the two frames preceding the current frame and then changes in the opposite manner at the current frame or when the brightness of the back light changes continuously in the two frames preceding the current frame and continues to change in the same manner at the current frame.

The method further includes keeping the brightness of the back light equal to brightness of the previous frame when the current control value is equal to the prior control value.

A driving apparatus for a liquid crystal display according to still another aspect of the present invention includes a brightness/color separator for converting data to be displayed into brightness components; a histogram analyzer for arranging the brightness components into a histogram for each frame; a back light; and a back light control for extracting a control value to determine brightness of the back light from the histogram and for controlling the brightness of the back light using the extracted control value of a current frame and control values of at least two frames earlier than the current frame.

In the driving apparatus, the control value is the most-frequent value or the average value.

The back light control includes a control value extractor for extracting the control value from the histogram; a storage for storing the extracted control value from the control value extractor; and a back light controller for controlling the brightness of the back light using the current control value from the control value extractor and the prior control values from the storage.

The back light controller controls the brightness of the back light to keep the brightness of the previous frame when the current control value is equal to the prior control value.

The back light controller controls the brightness of the back light to generate brightness corresponding to the current control value when the current control value is different from the prior control value.

BRIEF DESCRIPTION OF THE DRAWINGS

Aspects of the invention will be apparent from the following detailed description of the embodiments of the present invention with reference to the accompanying drawings, in which.

DETAILED DESCRIPTION OF THE PREFERRED EMBODIMENT

Figure 1:
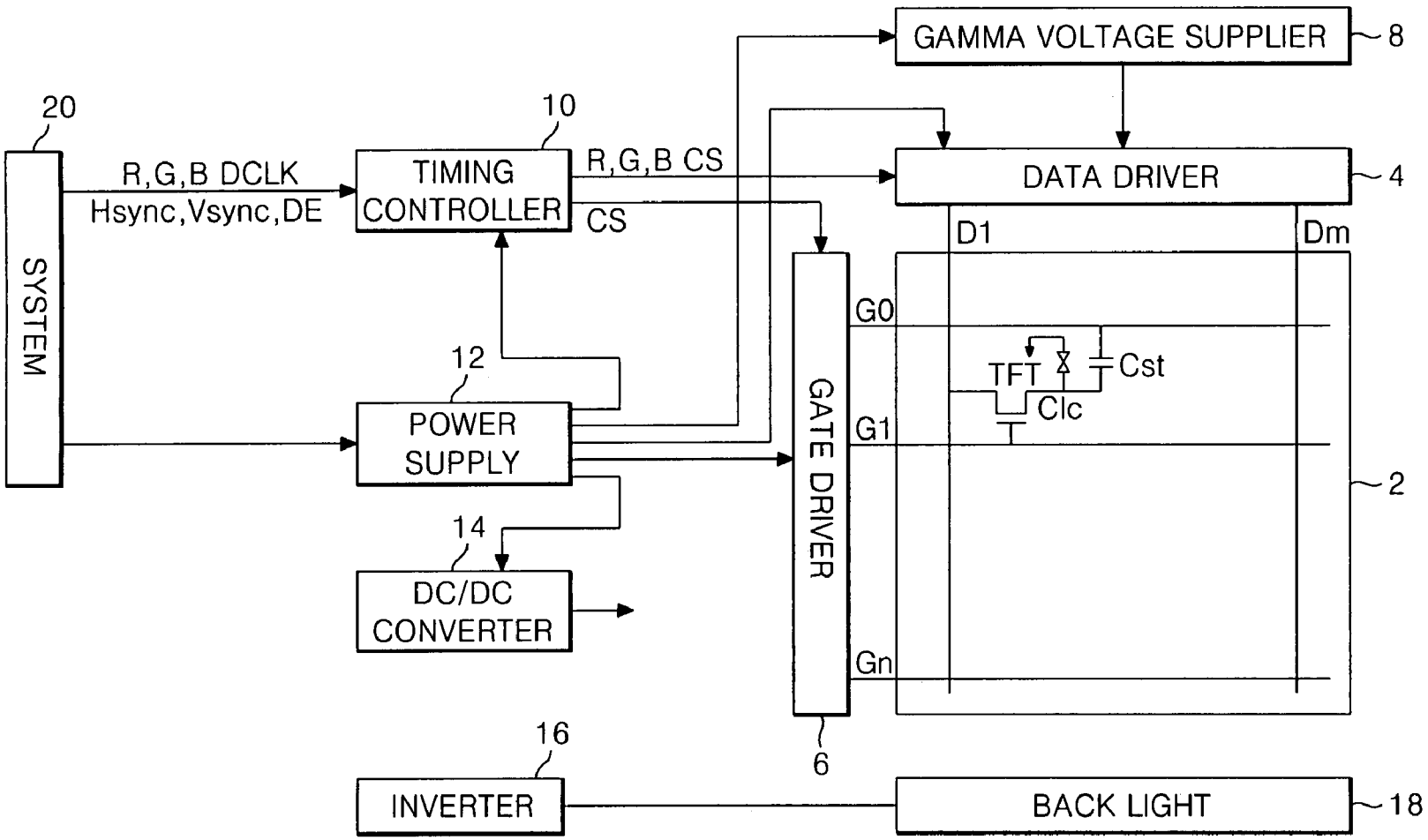
FIG. 1 RELATED ART
FIG. 1 is a schematic block diagram showing a configuration of a conventional driving apparatus for a liquid crystal display.
Figure 2:
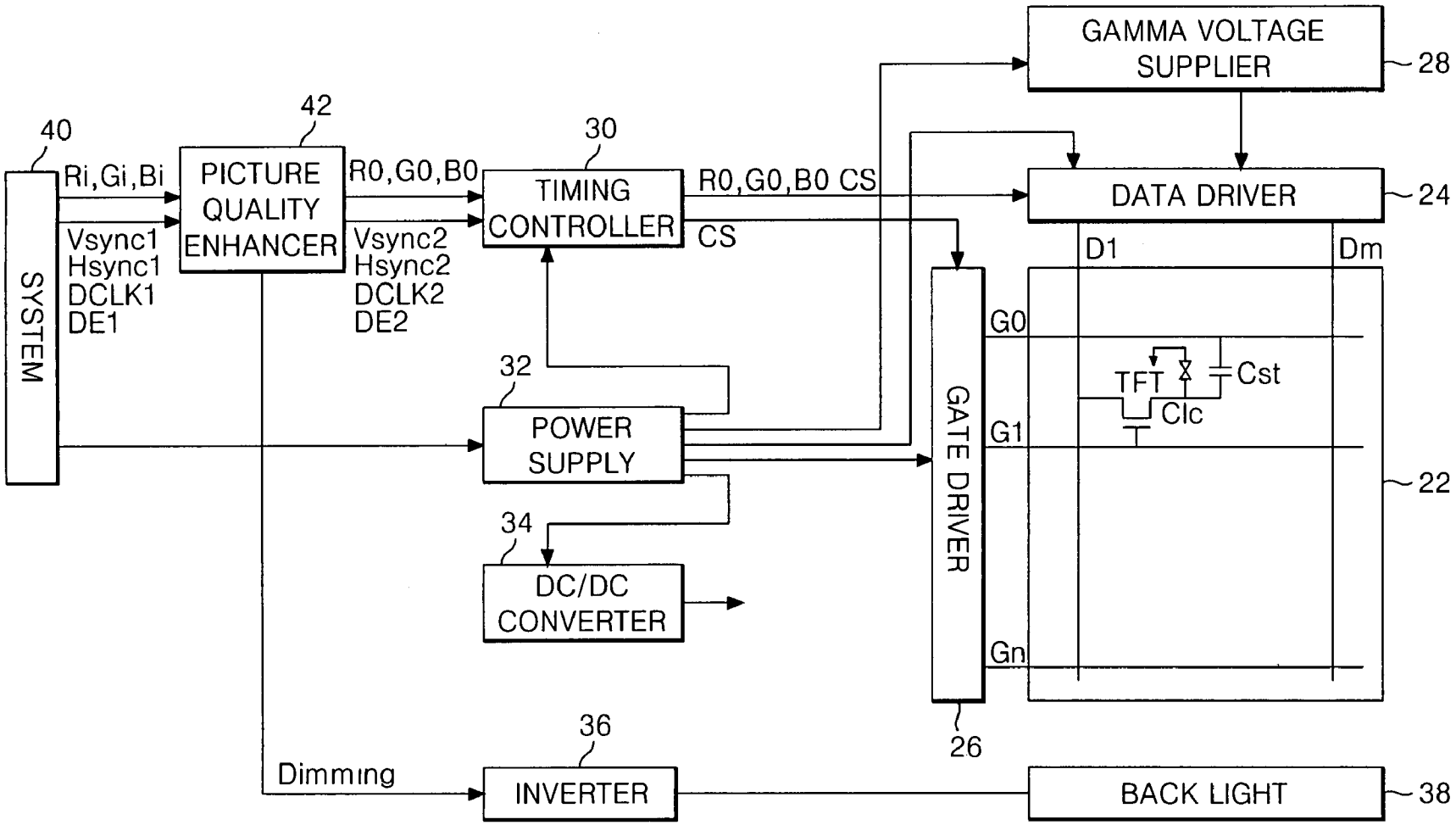
FIG. 2 is a schematic block diagram showing a configuration of a driving apparatus for a liquid crystal display according to an embodiment of the present invention.

FIG. 2 schematically shows a driving apparatus for a liquid crystal display (LCD) according to an embodiment of the present invention.

Referring to FIG. 2, the LCD driving apparatus according to the embodiment of the present invention includes a liquid crystal display panel 22 having m×n liquid crystal cells Clc arranged in a matrix type, m data lines D1 to Dm and n gate lines G1 to Gn intersecting each other and thin film transistors TFT provided at the intersections, a data driver 24 for applying data signals to the data lines D1 to Dm of the liquid crystal display panel 22, a gate driver 26 for applying scanning signals to the gate lines G1 to Gn, a gamma voltage supplier 28 for supplying the data driver 24 with gamma voltages, a timing controller 30 for controlling the data driver 24 and the gate driver 26 using a second synchronizing signal from a picture quality enhancer 42, a DC/DC converter 34 for generating voltages supplied to the liquid crystal display panel 22 using a voltage from a power supply 32, an inverter 36 for driving a back light unit 38, and a picture quality enhancer 42 for selectively emphasizing a contrast of the input data and for applying a brightness control signal Dimming corresponding to the input data to the inverter 36.

The system 40 applies first vertical/horizontal signals Vsync1 and Hsync1, a first clock signal DCLK1, a first data enable signal DE1 and first data Ri, Gi and Bi to the picture quality enhancer 42.

The liquid crystal display panel 22 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 28 applies a plurality of gamma voltages to the data driver 24.

The data driver 24 converts digital video data Ro, Go and Bo into analog gamma voltages (i.e., data signals corresponding to gray level values in response to a control signal CS from the timing controller 30, and applies the analog gamma voltages to the data lines D1 to Dm.

The gate driver 26 sequentially applies a scanning pulse to the gate lines G1 to Gn in response to a control signal CS from the timing controller 30 to thereby select horizontal lines of the liquid crystal display panel 22 supplied with the data signals.

The timing controller 30 generates the control signals CS for controlling the gate driver 26 and the data driver 24 using second vertical/horizontal synchronizing signals Vsync2 and Hsync2 and a second-clock signal DCLK2 inputted from the picture quality enhancer 42. The control signal CS for controlling the gate driver 26 is comprised of a gate start pulse GSP, a gate shift clock GSC and a gate output enable signal GOE, etc. Further, the control signal CS for controlling the data driver 24 is comprised of a source start pulse SSP, a source shift clock SSC, a source output enable signal SOE and a polarity signal POL, etc. The timing controller 30 re-aligns second data Ro, Go and Bo from the picture quality enhancer 42 to apply them to the data driver 24.

The DC/DC converter 34 boosts or drops a voltage of 3.3V inputted from the power supply 32 to generate a voltage supplied to the liquid crystal display panel 22. Such a DC/DC converter 14 generates a gamma reference voltage, a gate high voltage VGH, a gate low voltage VGL and a common voltage Vcom.

The inverter 36 applies a driving voltage (or driving current) corresponding to the brightness control signal Dimming from the picture quality enhancer 42 to the back light 38. In other words, a driving voltage (or driving current) applied from the inverter 36 to the back light 38 is determined by the brightness control signal Dimming from the picture quality enhancer 42. The back light 38 applies light corresponding to the driving voltage (or driving current) from the inverter 36 to the liquid crystal display panel 22.

The picture quality enhancer 42 extracts brightness components using the first data Ri, Gi and Bi from the system 40, and generates second data Ro, Go and Bo obtained by a change in gray level values of the first data Ri, Gi and Bi in correspondence with the extracted brightness components. In this case, the picture quality enhancer 42 generates the second data Ro, Go and Bo such that the contrast is selectively expanded with respect to the input data Ri, Gi and Bi.

Further, the picture quality enhancer 42 generates a brightness control signal Dimming corresponding to the brightness components to apply the brightness control signal to the inverter 36. The picture quality enhancer 42 extracts a control value capable of controlling the back light, for example, a most-frequent value (i.e., the gray level value occupied by the maximum number of the brightness components in the frame) and/or an average value (i.e., the average value of the brightness components in the frame), and generates the brightness control signal Dimming using the extracted control value. The picture quality enhancer 42 divides the brightness of the back light corresponding to the gray levels of the brightness components into at least two regions, and generates the brightness control signal Dimming such that regions of the brightness are selected in correspondence with the control value.

Moreover, the picture quality enhancer 42 generates second vertical/horizontal synchronizing signals Vsync2 and Hsync2, a second clock signal DCLK2 and a second data enable signal DE2 synchronized with the second data Ro, Go and Bo with the aid of the first vertical/horizontal synchronizing signals Vsync1 and Hsync1, the first clock signal DCLK1 and the first data enable signal DE1 inputted from the system 40.

Figure 3:
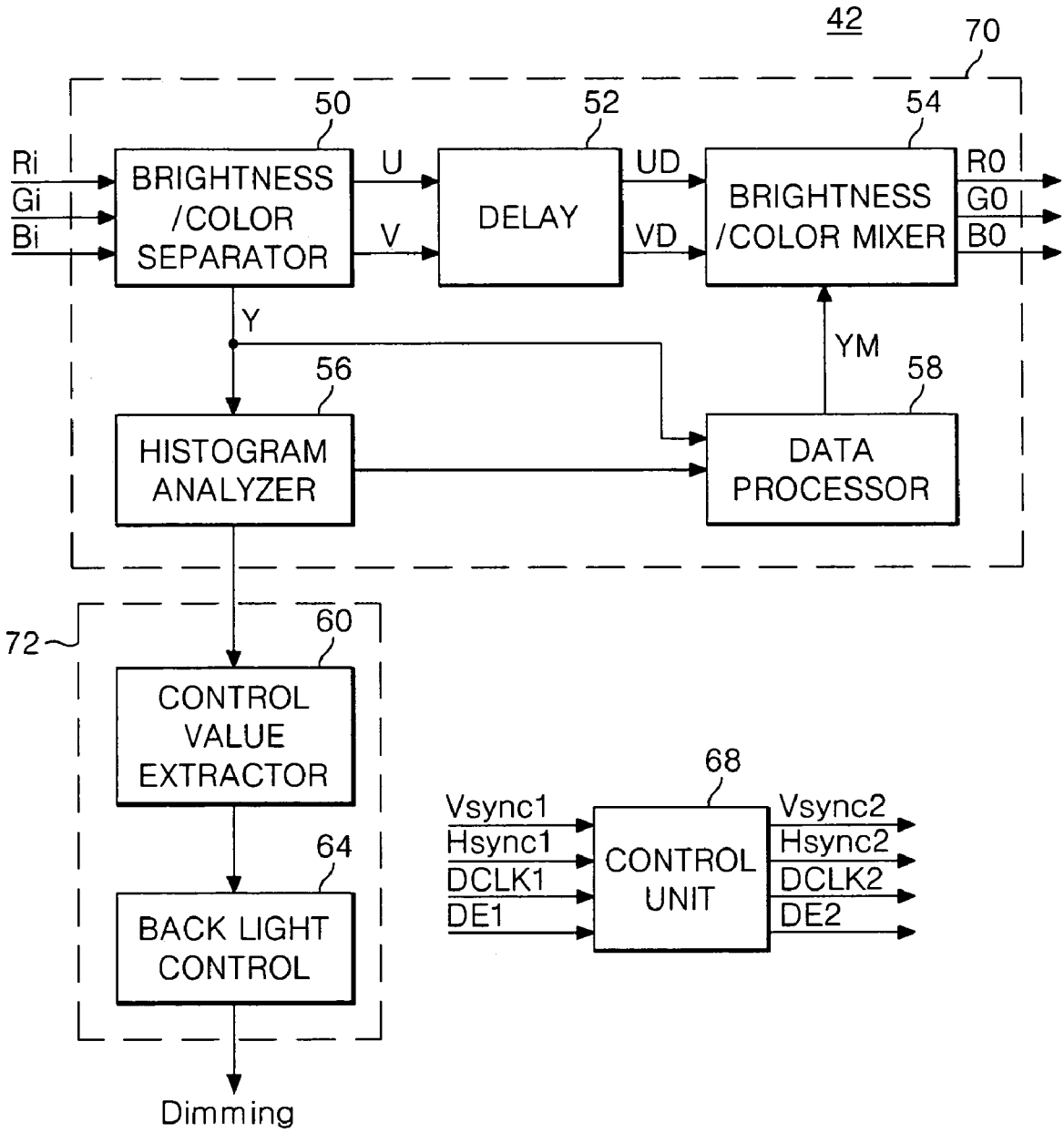
FIG. 3 is a block diagram of a first embodiment of the picture quality enhancer shown in FIG. 2.

To this end, as shown in FIG. 3, the picture quality enhancer 42 includes an image signal modulator 70 for generating the second data Ro, Go and Bo using the first data Ri, Gi and Bi, a back light controller 72 for generating the brightness control signal Dimming under control of the image signal modulator 70, and a control unit 68 for generating the second vertical/horizontal synchronizing signals Vsync2 and Hsync2, the second clock signal DCLK2 and the second enable signal DE2.

The image signal modulator 70 extracts brightness components Y from the first data Ri, Gi and Bi, and generates second data Ro, Go and Bo in which a contrast is partially emphasized with the aid of the extracted brightness components Y. To this end, the image signal modulator 70 includes a brightness/color separator 50, a delay 52, a brightness/color mixer 54, a histogram analyzer 56 and a data processor 58.

The brightness/color separator 50 separates the first data Ri, Gi and Bi into brightness components Y and chrominance components U and V. The brightness components Y and the chrominance components U and V are obtained by the following equations:

$$Y=0.229\times Ri+0.587\times Gi+0.114\times Bi \quad (1)$$

$$U=0.493\times(Bi-Y) \quad (2)$$

$$V=0.887\times(Ri-Y) \quad (3)$$

Figure 4:
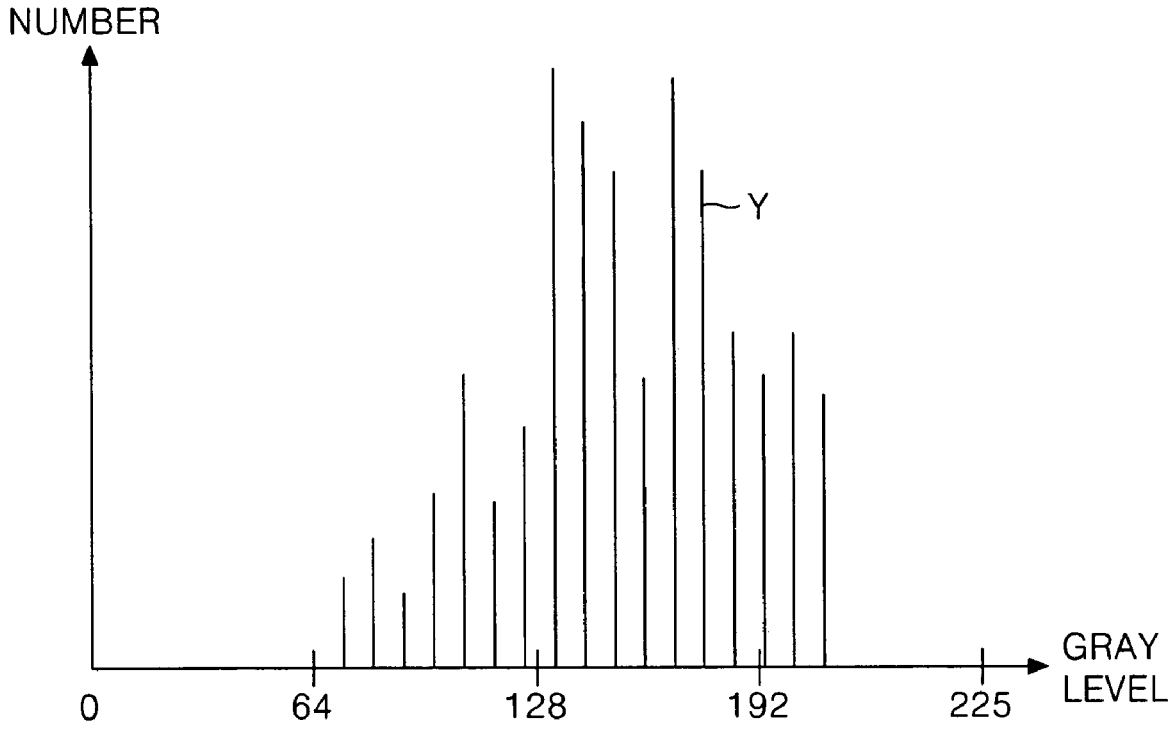
FIG. 4 is a graph showing an example of a histogram analyzed by the histogram analyzer shown in FIG. 3.

The histogram analyzer 56 divides the brightness components Y into gray levels in each frame. In other words, the histogram analyzer 56 arranges the brightness components Y of each frame to correspond to the gray levels, thereby obtaining a histogram as shown in FIG. 4. The shape of the histogram depends on the brightness components of the first data Ri, Gi and Bi.

The data processor 58 generates modulated brightness components YM having a selectively emphasized contrast using the analyzed histogram from the histogram analyzer 56. The data processor 58 generates modulated brightness components YM by various methods, such as those disclosed in Korean Patent Applications Nos. 2003-036289, 2003-040127 and 2003-041127, previously filed by the present applicants and herein incorporated by reference.

The delay 52 delays chrominance components U and V until the brightness components YM modulated by the data processor 58 are produced. Further, the delay 52 applies the delayed chrominance components VD and UD to the brightness/color mixer 54 to be synchronized with the modulated brightness components YM.

The brightness/color mixer 54 generates second data Ro, Go and Bo with the aid of the modulated brightness components YM and the delayed chrominance components UD and VD. The second data Ro, Go and Bo is obtained by the following equations:

$$Ro=YM+0.000\times UD+1.140\times VD \quad (4)$$

$$Go=YM-0.396\times UD-0.581\times VD \quad (5)$$

$$Bo=YM+2.029\times UD+0.000\times VD \quad (6)$$

Since the second data Ro, Go and Bo obtained by the brightness/color mixer 54 has been produced from the modulated brightness components YM having an expanded contrast, they have more expanded contrast than the first data Ri, Gi and Bi. The second data Ro, Go and Bo produced such that the contrast can be expanded, as mentioned above, is applied to the timing controller 30.

The control unit 68 receives the first vertical/horizontal synchronizing signals Vsync1 and Hsync1, the first clock signal DCLK1 and the first data enable signal DE1 from the system 40. Further, the controller 68 generates the second vertical/horizontal synchronizing signals Vsync2 and Hsync2, the second clock signal DCLK2 and the second data enable signal DE2 to be synchronized with the second data Ro, Go and Bo, and applies them to the timing controller 30.

The back light controller 72 extracts a control value from the histogram analyzer 56, and generates a brightness control signal Dimming using the extracted control value. The control value controls the brightness of the back light 38. For instance, the most-frequent value and/or average value may be used as the control value. The back light controller 72 includes a control value extractor 60 and a back light control 64.

Figure 5:
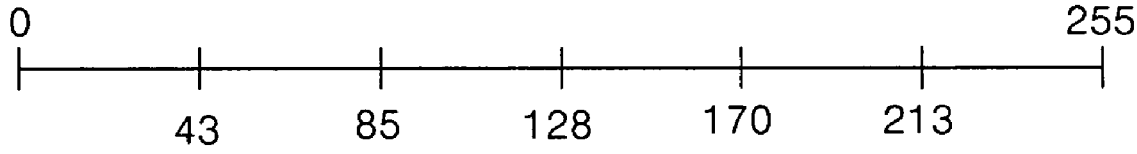
FIG. 5 depicts a brightness area for controlling brightness at the back light controller shown in FIG. 3.

As shown in FIG. 5, the back light control 64 divides the gray levels of the brightness components Y into a plurality of areas, and controls the back light 38 such that a different brightness can be supplied for each area. In other words, the back light control 64 determines the gray level of the control value and generates a brightness control signal Dimming to correspond to the area to which the control value belongs.

The control value extractor 60 extracts a control value from the histogram analyzer 56 to apply it to the back light control 64.

An operation procedure of the back light controller 72 will be described in detail below.

First, the control value extractor 60 extracts the histogram analyzed by the histogram analyzer 56 to apply the extracted control value to the back light control 64. The back light control 64 having received the control value checks the area (i.e., gray level value) to which a control value applied thereto belongs. In other words, the back light control 64 checks the area to which the control value belongs of a plurality of divided gray level values as shown in FIG. 5, and generates the brightness control signal Dimming corresponding thereto. The back light controller 64 then generates the brightness control signal Dimming such that light of increasing brightness is produced as the area to which the control value belongs increases.

The brightness control signal Dimming from the back light control 64 is applied to the inverter 36. The inverter 36 controls the back light 38 in response to the brightness control signal Dimming, thereby applying light corresponding to the brightness control signal Dimming to the liquid crystal display panel 22. In other words, the back light controller 72 divides the gray levels into a plurality of areas and applies the brightness control signal Dimming such that light of a different brightness for each area can be generated in correspondence with the control value, thereby displaying a vivid image. That is to say, the brightness is controlled in accordance with an area to which the control belongs, thereby displaying a picture having a distinct contrast on the liquid crystal display panel 22.

However, in such an embodiment, the brightness of the back light 38 is sensitive to the control value, which may cause sparkling to occur. For instance, if the control value is disposed close enough to the border between two areas such that the area to which the control value belongs alternates between successive frames, then the brightness of the back light 38 is changed substantially in the successive frames even though the brightness of the image changes relatively little. For example, sparkling will occur when switching between a gray level of 165 and a gray level of 175 when the areas of the gray levels are divided as shown in FIG. 5. In this case, the back light controller 64 controls the inverter 36 such that a first brightness is supplied when the control value represents the gray level of 165, whereas it controls the inverter 36 such that light of a second brightness which is higher than the first brightness is supplied when the control value represents the gray level of 175. Changing the control value back and forth between two adjacent areas in successive frames multiple times may cause sparkling in the liquid crystal display panel 22.

Figure 6:
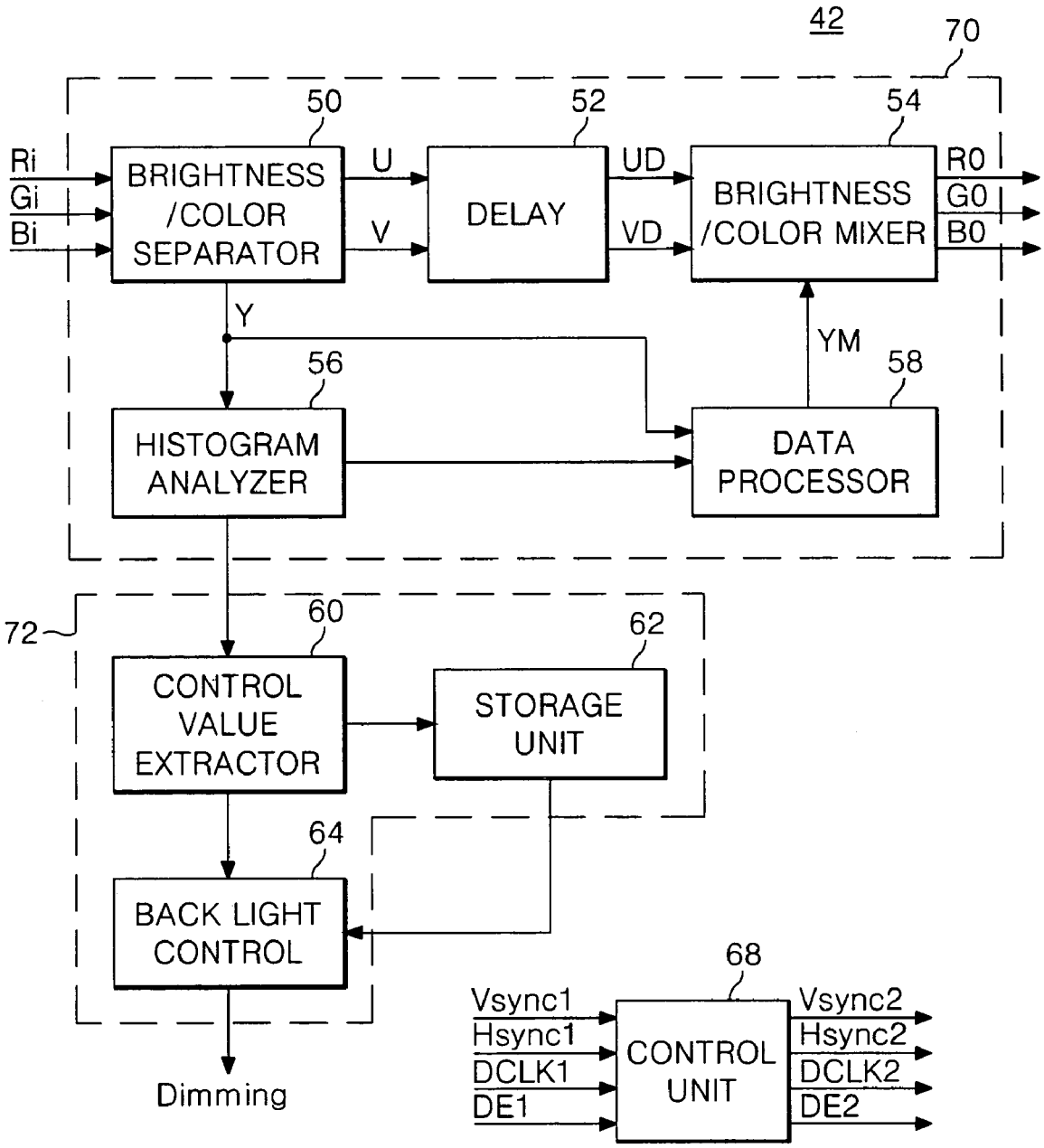
FIG. 6 is a block diagram of a second embodiment of the picture quality enhancer shown in FIG. 2.

The picture quality enhancer according another embodiment of the present invention shown in FIG. 6 may mitigate this problem. Since configurations and functions of an image signal modulator 70 and a control unit 68 except for a back light controller 72 in the embodiment shown in FIG. 6 are identical to those of the embodiment shown in FIG. 3, a detailed explanation as to these elements will be omitted.

Referring to FIG. 6, the back light controller 72 according to another embodiment of the present invention extracts a control value from the histogram analyzer 56, and generates a brightness control signal Dimming using the extracted control value. The back light controller 72 divides the gray levels into a plurality of areas, and controls the brightness of the back light 38 in correspondence with the area to which the control value belongs. Each area from which the control value is extracted causes the back light 38 to be controlled to have a different brightness. Moreover, the back light controller 72 compares the control value of the current frame with the control values of at least one of the frames preceding the current frame to prevent the brightness of the back light 38 from being overly sensitive to the control value of the current frame.

To this end, the back light controller 72 includes a control value extractor 60, a storage unit 62 and a back light control 64. As before, the control value can be the most-frequent value and/or the average value.

The control value extractor 60 extracts the control value from the histogram analyzer 56 to apply it to the storage unit 62 and the back light control 64.

The storage unit 62 stores at least the control values that were extracted from the two frames prior to the current frame. In other words, the control value of the previous frame (the frame immediately before the current frame, hereinafter referred to as the previous control value) and the control value of the frame immediately preceding the previous frame (the frame two frames before the current frame, hereinafter referred to as the prior control value) are stored in the storage unit 62. The prior control value may also be any frame that precedes the previous frame, rather than merely the frame immediately preceding the previous frame.

The back light controller 64 divides the gray levels of the brightness components Y into a plurality of areas as shown in FIG. 5, and controls the back light 38 such that a different brightness is supplied for each area. In other words, the back light controller 64 determines the gray level of the control value, and generates a brightness control signal Dimming to correspond to the area to which the control value belongs. The back light controller-64 generates the brightness control signal Dimming such that the brightness of the previous frame is kept when the prior control value supplied from the storage unit 62 is identical to the current control value supplied from the control value extractor 60.

An operation procedure of the back light controller 72 will be described in detail below.

Firstly, the control value extractor 60 extracts a control value from a histogram analyzed by the histogram analyzer 56 to apply it to the storage unit 62 and the back light control 64.

The storage unit 62 having received the control value stores the current control value and, at the same time, applies the prior control value stored therein to the back light control 64.

The back light control 64 receives the current control value from the control value extractor 60 and receives the prior control value from the storage unit 62. The back light control 64 having received the current control value and the prior control value checks whether or not the current control value is equal to the prior control value. If the current control value is equal to the prior control value, then the back light control 64 generates a brightness control signal Dimming such that the brightness of the previous frame (i.e. the previous brightness) is maintained irrespective of the current control value. On the other hand, if the current control value is not equal to the prior control value, the back light control 64 generates a brightness control signal Dimming to correspond to the area to which the current control value belongs.

The brightness control signal Dimming generated from the back light control 64 is applied to the inverter 36. The inverter 36 controls the back light 38 in response to the brightness control signal Dimming, thereby applying light corresponding to the brightness control signal Dimming to the liquid crystal display panel 22. In other words, the present back light controller 72 divides the gray levels into a plurality of areas, and supplies the brightness control signal Dimming such that a different brightness can be produced for each area in correspondence with the control value, thereby displaying a vivid image. That is to say, the back light controller 72 controls the brightness of the light in accordance with the area to which the control value belongs, thereby displaying a picture having a distinct contrast on the liquid crystal display panel 22.

Furthermore, the back light control 64 compares the prior control value with the current control value, and, if it is determined that the prior control value is equal to the current control value, maintains the brightness of the previous frame. Accordingly, the brightness is changed in correspondence with one of the control values, so that it becomes possible to prevent sparkling from occurring.

For example, if the control value alternates between a gray level of 165 and a gray level of 175 when the gray level areas are divided as shown in FIG. 5, then the back light 38 maintains the brightness of the previous frame irrespective of the current control value. It is assumed that the prior control value has been stored in the storage unit 62. In other words, since the current control value is equal to the prior control value, the liquid crystal display panel 22 maintains the brightness of the previous frame. That is to say, brightness is not changed between the frames, even if the control value shifts areas between the frames.

Moreover, the back light control 64 keeps the same brightness with respect to the previous frame under a specific condition in which sparkling may appear. Control values corresponding to the specific condition are stored in the storage unit 62.

A process of keeping the same brightness with respect to the previous frame at the back light control 64 in correspondence with the specific condition will be described in detail below.

Figure 7A:
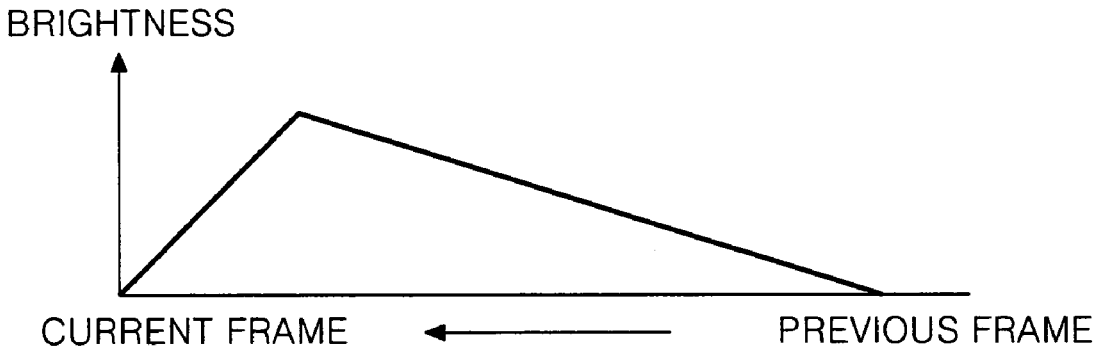
FIGS. 7A, 7B, 8A and 8B are graphs showing a condition under which the brightness of the previous frame in the back light controller shown in FIG. 6 is maintained.

Firstly, FIG. 7A represents an image that continuously brightens and then becomes dark at the current frame. In this case, then the back light control 64 controls the brightness of the back light 38 using the previous control value. In other words, in the above case, the back light control 64 controls the back light 38 such that the brightness of the previous frame is kept irrespective of the current control value, thereby preventing sparkling from being generated. The back light control 64 determines that the brightness of the image is increasing and then becomes dark at the current frame when the control values have the following condition:

$$CSN^1 < CSN^2,\ CSN^2 \geqq CSN^3,\ CSN^3 \geqq CSN^4,\ CSN^4 \geqq CSN^5, \tag{7}$$

In the above equation, 'CSN' represents the control value, and "X" represents the position of the frame. A larger value of "X" means a control value farther from the current frame while a smaller value of "X" means a control value closer to the current frame.

It can be seen from the above equation (7) that the control value becomes larger with decreasing distance from the farthest frame (the frame farthest in time from the current frame) to the frame immediately preceding the current frame (previous frame). Thus, the brightness of the back light 38 determined by the control value also becomes gradually larger. The current control value $CSN^1$ has a smaller gray level value than that of the previous control value $CSN^2$. If the current control value $CSN^1$ has a smaller gray level value than that of the previous control value $CSN^2$, then decreasing the brightness of the back light 38 should be performed. However, since, if brightness of the back light 38 is gradually increasing and then suddenly decreases, sparkling may appear at the liquid crystal display panel 22, the present embodiment keeps the brightness of the current frame equal to the brightness of the previous frame when the control value meets the condition indicated in the above equation (7).

Figure 7B:
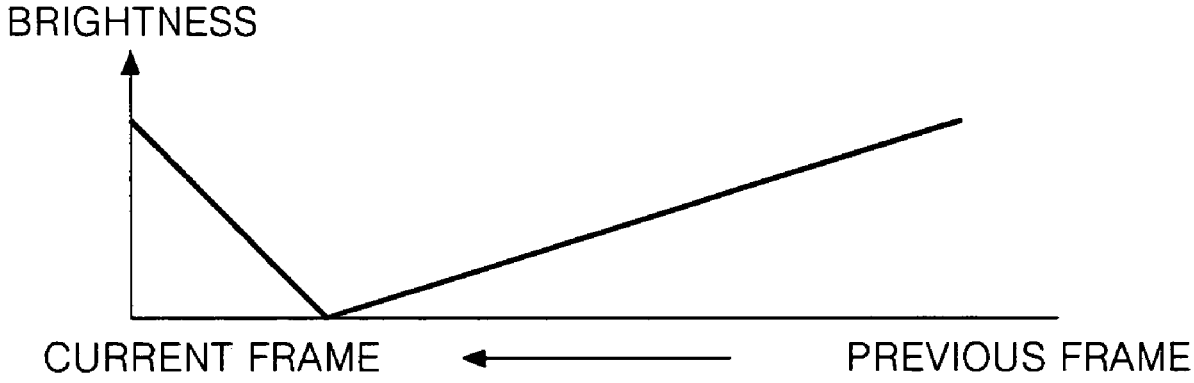

Next, FIG. 7B represents an image that darkens continuously and then becomes bright at the current frame. In this case, then the back light control 64 controls the brightness of the back light 38 using the previous control value. In other words, in the above case, then the back light control 64 controls the back light 38 such that the brightness of the previous frame is kept irrespective of the current control value, thereby preventing sparkling from occurring. Meanwhile, the back light control 64 determines that the image is darkening and then becomes brighter at the current frame when control values meet the following condition:

$$CSN^1 > CSN^2,\ CSN^2 \leqq CSN^3,\ CSN^3 \leqq CSN^4,\ CSN^4 \leqq CSN^5, \tag{8}$$

It can be seen from the above equation (8) that the control value becomes smaller as it proceeds from the farthest frame to the previous frame. Thus, the brightness of the back light 38 determined by the control value also decreases gradually. Meanwhile, the current control value $CSN^1$ has a larger gray level value than that of the previous $CSN^2$. If the current control value $CSN^1$ has a larger gray level value than that of the previous control value $CSN^2$, then increasing the brightness of the back light 38 should be performed. However, since, if brightness of the back light 38 is gradually increased and then is suddenly increased, sparkling may appear at the liquid crystal display panel 22, the present embodiment keeps the brightness of the current frame equal to the brightness of the previous frame when the control value meets the condition indicated in the above equation (8).

In other words, the embodiment of FIG. 7B keeps the brightness of the previous frame when the image continuously brightens and then becomes dark at the current frame and when the image is continuously darkens and then becomes bright at the current frame, thereby preventing sparkling from occurring in the liquid crystal display panel 22.

Figure 8A:
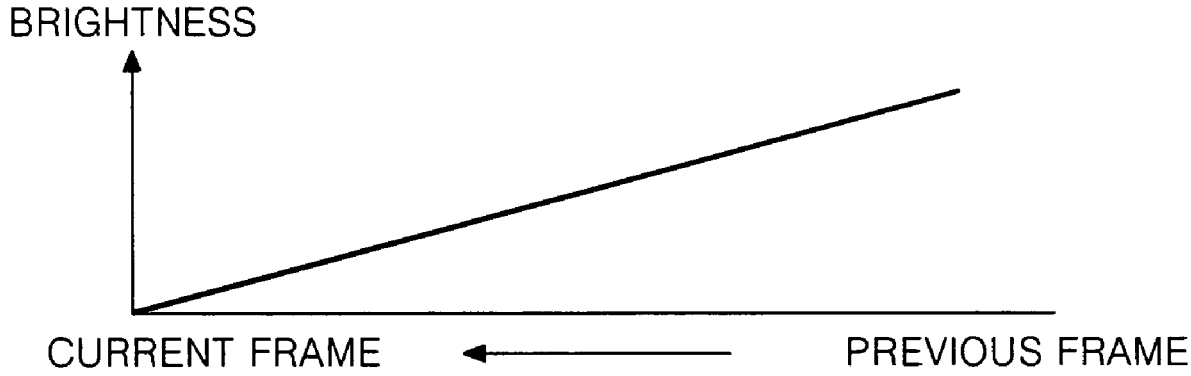
Figure 8B:
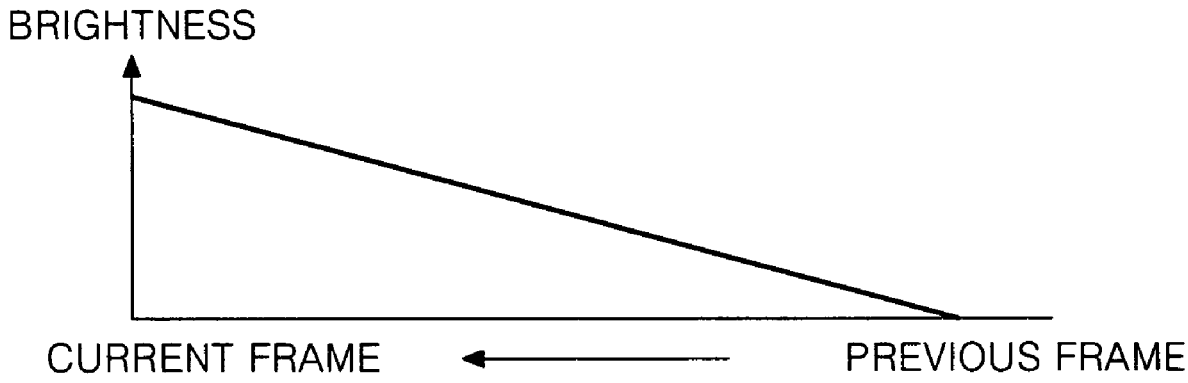

Additionally, the present back light control 64 controls the brightness of the back light 38 to keep the brightness of the previous frame at the current frame both when the brightness of the back light 38 decreases as indicated in FIG. 8A and the following equation (9) and when the brightness of the back light 38 increases as indicated in FIG. 8B and the following equation (10). Since the brightness of the liquid crystal display panel 22 is continuously changed when the brightness of the back light 38 continuously increases or decreases, sparkling appears at the liquid crystal display panel 22.

$$CSN^1 \leqq CSN^2,\ CSN^2 \leqq CSN^3,\ CSN^3 \leqq CSN^4,\ CSN^4 \leqq CSN^5, \quad (9)$$

$$CSN^1 \geqq CSN^2,\ CSN^2 \geqq CSN^3,\ CSN^3 \geqq CSN^4,\ CSN^4 \geqq CSN^5, \quad (10)$$

In the above embodiments, control values of the earlier frames $CSN^2$, $CSN^3$, . . . are compared with the current control value so as to determine the conditions indicated in FIGS. 7A, 7B, 8A, and 8B. More specifically, the storage unit 62 stores the control values of a plurality of the earlier frames, not just those of the two frames preceding the current frame. Thus, while some embodiments may only be required to store three control values (the current control value, the previous control value, and the prior control value), in other embodiments, control values of earlier frames may be stored in addition.

As described above, according to the present invention, data is changed into brightness components, arranged into a histogram for each frame, and the brightness of the back light is controlled by a control value extracted from the histogram, thereby displaying a vivid image. Furthermore, a control value of the previous frame is kept when a control value of frames prior to the current frame is equal to the current control value, so that it becomes possible to prevent the brightness of the back light from being sensitively changed in correspondence with the control value and thus prevent sparkling from being generated in the liquid crystal display panel. Moreover, the back light is controlled to keep brightness of the previous frame in a specific condition in which sparkling is generated from the liquid crystal display panel, thereby preventing sparkling from being generated in the liquid crystal display panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a display, comprising:

(A) converting data to be displayed in a current frame into brightness components;

(B) arranging the brightness components into a histogram of gray levels and thereafter extracting a current control value from the histogram;

(C) storing the current control value; and (D) controlling brightness of a back light using the current control value and a prior control value of a prior frame preceding a previous frame that is immediately before the current frame, wherein (D) comprises maintaining the brightness of the back light from the brightness of the previous frame when the current control value is equal to the prior control value.

2. The method of claim 1, wherein the control value is a most-frequent value occupied by the maximum number of brightness components in the histogram or an average value of the brightness components in the histogram.

3. The method of claim 1, wherein (D) comprises changing the brightness of the back light in correspondence with the current control value when the current control value is different from the prior control value.

4. The method of claim 1, wherein (D) comprises changing the brightness of the back light in correspondence with the brightness area to which the control value belongs.

5. The method of claim 1, further comprising maintaining the brightness of the back light from that of the previous frame irrespective of the current control value in correspondence with predetermined conditions.

6. The method of claim 5, wherein the predetermined conditions comprises the brightness of the back light continuously changing in one direction from a frame preceding the prior frame to the current frame and then changing in the opposite direction at the current frame.

7. The method of claim 5, wherein the predetermined conditions comprises the brightness of the back light continuously changing in one direction from a frame preceding the prior frame through the current frame.

8. A driving apparatus for a display, comprising:

a brightness/color separator for converting data of a current frame into brightness components;

a histogram analyzer for arranging the brightness components into a histogram;

a back light that provides light for the display; and a back light control that extracts a current control value from the histogram to determine brightness of the back light and controls the brightness of the back light using the current control value, a previous control value of a previous frame immediately preceding the current frame and a prior control value of a prior frame immediately preceding the previous frame, wherein the back light control controls the brightness of the back light to keep the brightness of the previous frame when the current control value is equal to the prior control value.

9. The driving apparatus of claim 8, wherein the control value is a most-frequent value occupied by the maximum number of brightness components in the histogram and an average value of the brightness components in the histogram.

10. The driving apparatus of claim 8, wherein the back light control comprises:

a control value extractor for extracting the current control value from the histogram;

a storage for storing the current control value from the control value extractor; and a back light controller for controlling the brightness of the back light using the current control value from the control value extractor and the previous and prior control values from the storage means.

11. The driving apparatus of claim 10, wherein the back light controller controls the brightness of the back light to generate a brightness corresponding to the current control value when the current control value is different from the prior control value.

12. A method of driving a current frame of a display, the method comprising:

storing control values extracted from brightness components in the current frame as well as a plurality of frames before the current frame; and comparing a current control value of the current frame to an earlier control value of an earlier frame at least two frames before the current frame; and controlling the brightness of the back light using the current control value when the current control value and the earlier control value lie outside a predetermined range of values from each other.

13. The method of claim 12, further comprising extracting each control value from at least one statistic of the brightness components in the particular frame.

14. The method of claim 12, further comprising controlling the brightness of the back light using a previous control value of a frame between the current frame and the earlier frame when the current control value and the earlier control value lie within a predetermined range of values from each other.

15. The method of claim 14, further comprising selecting the control value of the frame immediately preceding the current frame as the previous control value.

16. The method of claim 12, further comprising controlling the brightness of the back light using a previous control value of a frame between the current frame and the earlier frame when the brightness of the backlight changes monotonically with time from a frame before the current frame to a frame immediately preceding the current frame and the brightness of the backlight to be used in the current frame does not continue changing in the same manner.

17. The method of claim 16, further comprising controlling the brightness of the back light using the previous control value only when the brightness of the back light in at least the three frames immediately preceding the current frame has changed monotonically.

18. The method of claim 12, further comprising controlling the brightness of the back light using a previous control value of a frame between the current frame and the earlier frame when the brightness of the backlight changes monotonically with time from a frame before the current frame through the current frame.

19. The method of claim 18, further comprising controlling the brightness of the back light using the previous control value only when the brightness of the back light in at least the three frames immediately preceding the current frame as well as the current frame has changed monotonically.

* * * * *